US009669285B2

(12) United States Patent
Eiselin

(10) Patent No.: US 9,669,285 B2
(45) Date of Patent: Jun. 6, 2017

(54) SNOW SPORTS EQUIPMENT

(71) Applicant: Andreas Eiselin, Engelberg (CH)

(72) Inventor: Andreas Eiselin, Engelberg (CH)

( * ) Notice: Subject to any disclaimer, the term of this patent is extended or adjusted under 35 U.S.C. 154(b) by 0 days.

(21) Appl. No.: 14/928,199

(22) Filed: Oct. 30, 2015

(65) Prior Publication Data

US 2016/0121196 A1 May 5, 2016

(30) Foreign Application Priority Data

Oct. 31, 2014 (CH) ..... 1670/14

(51) Int. Cl.

| | |
|---|---|
| ***A63C 5/044*** | (2006.01) |
| ***A63C 5/02*** | (2006.01) |
| ***A63C 5/06*** | (2006.01) |
| ***A63C 7/02*** | (2006.01) |

(52) U.S. Cl.

CPC ..... *A63C 5/044* (2013.01); *A63C 5/02* (2013.01); *A63C 5/06* (2013.01); *A63C 7/02* (2013.01)

(58) Field of Classification Search

CPC .. A63C 5/044; A63C 5/02; A63C 5/04; A63C 5/0417; A63C 5/0422; A63C 5/048; A63C 5/0485; A63C 5/00; A63C 7/00; A63C 7/02; A63C 7/04; A63C 7/10; A63C 2201/06; A63C 2203/00; A63C 2203/06; A63C 2203/10; A63C 5/06

See application file for complete search history.

(56) References Cited

U.S. PATENT DOCUMENTS

| | | | | |
|---|---|---|---|---|
| 1,989,377 A * | 1/1935 | Osborn | ..... | A63C 7/02 280/604 |
| 3,178,194 A * | 4/1965 | Buchmuller | ..... | A63C 7/02 280/604 |
| 5,551,728 A * | 9/1996 | Barthel | ..... | A63C 5/02 280/14.1 |

(Continued)

FOREIGN PATENT DOCUMENTS

| | | |
|---|---|---|
| CH | 74 326 A2 | 7/2012 |
| DE | 31 34 051 A1 | 3/1983 |
| JP | 7-34875 U | 6/1995 |

OTHER PUBLICATIONS

European Search Report dated Feb. 26, 2016 issued in corresponding EP Application No. 15191700.2.

*Primary Examiner* — Brian Swenson
(74) *Attorney, Agent, or Firm* — Birch, Stewart, Kolasch & Birch, LLP

(57) ABSTRACT

A piece of snow sports equipment comprises a sliding board with a sheetlike central part (110) which extends in a longitudinal direction, and two sheetlike side parts (120, 130) which are fastened to the central part (110) on both sides. The central part (110) has a sliding coating (115) on a lower side. The side parts (120, 130) can be folded over from a first position, in which a first main surface of the side parts (120, 130) is substantially co-planar with the lower side of the central part (110), into a second position, in which the side parts (120, 130) are folded under the central part (110) such that the first main surfaces of the side parts (120, 130) are supported on the lower side of the central part (110). Second main surfaces of the side parts (120, 130), which second main surfaces lie opposite the first main surfaces, have a climbing skin (125, 135).

15 Claims, 7 Drawing Sheets

(56) References Cited

U.S. PATENT DOCUMENTS

| | | | | |
|---|---|---|---|---|
| 5,857,682 | A * | 1/1999 | Hyman | A63C 5/03 280/14.21 |
| 7,543,839 | B2 * | 6/2009 | Hartmann | A63C 7/04 280/604 |
| 8,528,930 | B2 * | 9/2013 | Titterington | A63C 10/28 280/623 |
| 8,876,144 | B1 * | 11/2014 | Darnell | A63C 5/06 280/611 |
| 9,010,797 | B2 * | 4/2015 | Elliott | A63C 7/04 280/604 |
| 9,108,101 | B2 * | 8/2015 | Gilson | A63C 5/03 |
| 2004/0251287 | A1 * | 12/2004 | Myers | A45C 15/00 224/401 |
| 2009/0026731 | A1 * | 1/2009 | Stewart, III | A63C 5/06 280/611 |
| 2010/0171288 | A1 * | 7/2010 | Nicosia | A63C 5/0422 280/609 |
| 2011/0285109 | A1 * | 11/2011 | Horn | A63C 5/02 280/608 |
| 2013/0134691 | A1 * | 5/2013 | Holzer | A63C 7/02 280/604 |

* cited by examiner

SNOW SPORTS EQUIPMENT

TECHNICAL FIELD

The invention relates to a piece of snow sports equipment.

PRIOR ART

Snow sports equipment in the form of sliding boards, in particular skis and snowboards, is known. Existing snow sports equipment provides either an optimum piece of descent equipment or an optimum piece of ascent equipment. If snow sports equipment is used for ascent, for example cross-country skis, climbing skins are customarily attached by hand to the lower side of the ski and are removed again for the descent. The attachment takes place in particular by means of an adhesive, and mechanical fastening elements are also used in an assisting capacity. Alternatively, skins may also stick to the ski by means of adhesion.

It is difficult to ascend with an optimum piece of descent equipment and it is difficult to descend with an optimum piece of ascent equipment.

The demands imposed on snow sports equipment are opposed for the ascent and on the descent. The following properties are advantageous:

For the Ascent:
light weight
little tapering
narrow support surface
climbing skin to prevent sliding back On the Descent:
heavy weight
severe tapering
wide support surface
sliding coating In addition, the attaching and removing of climbing skins is very fiddly (especially in wind and weather). The adhesive property of climbing skins decreases with each change and particularly wet or frozen skins do not adhere at all under some circumstances.

SUMMARY OF THE INVENTION

It is the object to develop a piece of snow sports equipment to the effect that said piece of snow sports equipment exhibits improved properties both on the descent and for the ascent.

The achievement of the object is defined by the features of Claim 1. According to the invention, the piece of snow sports equipment comprises a sliding board with a sheetlike central part which extends in a longitudinal direction, and two sheetlike side parts which are fastened to the central part on both sides, wherein a) the central part has a sliding coating on a lower side,
b) the side parts can be folded over from a first position, in which a first main surface of the side parts is substantially co-planar with the lower side of the central part, into a second position, in which the side parts are folded under the central part such that the first main surfaces of the side parts are supported on the lower side of the central part, and wherein
c) second main surfaces of the side parts, which second main surfaces are opposite the first main surfaces, have a climbing skin.

Both the central part and the side parts therefore extend substantially in the same longitudinal direction both in the first and in the second position. In the first position, the side parts are arranged next to the central part in the transverse direction such that a continuous main surface is formed at least on the lower side, preferably also on the upper side. In the second position, the side parts are folded over essentially by 180° about a longitudinal axis under the central part, and the second main surfaces of the side parts lie parallel to the lower side of the central part, at a distance which corresponds to the thickness of the side parts.

The climbing skin can be a skin in the narrower sense, but—as is known per se—said climbing skin can also be realized by artificially attached structures or special materials introduced into the surface. Of central importance is the fact that the climbing skin prevents the sliding board from slipping rearwards, but permits sliding forwards.

The invention can be used in particular in conjunction with conventional cross-country skis, but also with what are referred to as splitboards, i.e. snowboards, which can be divided in the longitudinal direction for the ascent.

The advantage of the invention consists in that the piece of snow sports equipment can be brought by simple folding over from the first configuration ("ascent"), in which it is narrow and provided on the lower side with a climbing skin, into a second configuration ("descent"), in which it is wide and is provided with a sliding coating on the lower side. By means of the additional elevation by the fold-over parts, an increased level of grip is produced in the ascent. The awkward attaching and removing of the skins is entirely dispensed with and, in addition, so too is the risk of the skins not even sticking. In addition, because of the raised side parts, increased buoyancy and a better steering behavior arise during the descent.

Advantageously, the side parts have a descent edge on an edge located on the outside in the first position and a sliding coating on the first main surface. The side parts therefore completely fulfill the function of the corresponding regions of known sliding boards with or without an attached climbing skin both during the ascent (climbing skin) and during the descent (sliding coating, descent edge).

The central part preferably has a main portion with a substantially constant width along the longitudinal direction, and the side parts have a tapering in a portion, the longitudinal extent of which corresponds to that of the main portion of the central part. The main portion includes in particular essentially the entire length of the sliding board, except for the front tip region and optionally a region at the rear end of the sliding board.

In the first position of the side parts for the descent, a tapered sliding board is produced, wherein the tapering can in principle be optimally oriented to the descent. By the side parts being folded over into the second position, a narrower sliding board is produced which is substantially untapered because the boundary of the sliding board is no longer formed by the tapered outer shape of the side parts, now located on the inside, but rather by the substantially rectilinear outer shape of the central part. The narrow untapered sliding board is readily suitable for the ascent.

Alternatively, the invention can also be used in conjunction with (substantially) untapered sliding boards.

Advantageously, the climbing skin is attached fixedly on the second main surface. This means that said climbing skin is not removed within the scope of customary use. Of course, it may be expedient to replace the climbing skin after a certain period of use. This will take place as a rule in a workshop.

The fixed attachment can take place in a simple and cost-effective manner, for example with a suitable adhesive.

The risk of the climbing skin becoming detached within the context of customary use is minimized.

In a preferred embodiment, a hinge mechanism is arranged between the central part and each of the side parts, wherein the hinge mechanism is preferably formed by a band which is fastened in a sheetlike manner on a side surface of the central part and on a side surface of the side part. The hinge mechanism or the band have in particular the task of holding the respective side part in the position thereof axially and in a direction perpendicular to the main surfaces of the main part and side part. Suitable bands are manufactured from a durable material, for example from a fiber-reinforced, bendy plastics band. Said bands can be adhesively bonded by one of the main surfaces thereof to the mentioned side surfaces of the main part and side part, which are adjacent to each other in the first position.

Instead of bands, the hinge mechanism can be realized by other elements, for example by classic hinges. The hinge mechanism may be of substantially continuous design or may comprise a plurality of spaced-apart elements in the longitudinal direction of the sliding board.

In a further preferred embodiment, the central part and the side parts are connected to each other by at least one pull-release cable. By tensioning of the cable or of the cables, the side parts can be particularly readily coupled mechanically to the central part, in particular in the first position. A change in position of the side parts is made possible by releasing the cable or the cables.

In the case of a splitboard, the pull-release cable or the pull-release cables can also be used for fastening the two parts of the splitboard to each other.

The at least one pull-release cable preferably comprises a cable which is guided through through-openings in the central part and in at least one of the side parts, and a tensioning and locking mechanism for tensioning and locking the cable when the at least one side part is in the first or second position. A cable can connect the central part to the two side parts, or there are separate cables for the two side parts. In addition, a side part can interact with the central part via a plurality of cables. In a preferred configuration, there are two pull-release cables, one in the front part of the sliding board (in front of the binding region) and a second in the rear part of the sliding board (behind the binding region), wherein the two pull-release cables each interact with the two side parts.

The through-openings and further guiding elements for the cables are advantageously directed in such a manner that the course of the cables does not fall short of certain minimum radii of, for example, 30 mm, in particular 40 mm. The actuating force can thus be kept within a range which permits easy manual actuation.

Suitable tensioning and locking mechanisms for pull-release cables are known. Corresponding products are commercially available, for example, from Boa Technology Inc., Denver (Colo.), USA.

Advantageously, the through-openings are arranged in the central part and in the at least one side part in such a manner that, in the first position of the at least one side part, the cable runs entirely within a basic body of the central part and of the at least one side part in a contact region of the central part and of the at least one side part.

The contact region is formed here by those regions of the central part and of the side part which are adjacent to one another and in which said parts are connected to one another by the pull-release cable. The cable preferably runs substantially completely within the central part and the side part and, in the case of an actuating element, protrudes upwards at most from the basic body of the central part in a central region of the central part.

The concealed arrangement of the cable is esthetically advantageous, but also improves the safety during the descent by it not being possible for the cable to become hooked, for example, on protruding roots or branches or other objects.

The piece of snow sports equipment preferably comprises means for locking the side parts in the second position, wherein the means comprise elements for the mutual fastening of the side parts to each other. As a result, the side parts can easily be locked in the second position. The elements for the mutual fastening can be, in particular, hook-like fittings which are arranged spaced apart in the longitudinal direction, connect the two side parts to each other substantially in the transverse direction and are completely accommodated in the intermediate space between the two side parts. Said fittings can enter automatically into engagement with each other when the side parts are folded over, or they are actuated manually by the user.

The side parts may be locked in some other way, for example by the side parts being fastened by the first main surface thereof to the lower side of the central part, for example magnetically or by mechanical elements.

A piece of snow sports equipment according to the invention can have locking elements arranged on an upper side of the central part for supporting the side parts in the first position. Said locking elements support the side parts against the pressure exerted from below. They can be used instead of or in addition to the pull-release cable, and optionally only in sections along the longitudinal extent of the sliding board.

Advantageously, the central part has a cover sheet on an upper side, wherein the cover sheet protrudes laterally over a basic body of the central part in order to support the side parts in the first position.

This measure can also be used in addition to or instead of the pull-release cable and/or the locking elements.

In general, locking elements, a protruding cover sheet, both measures or neither thereof can be used, depending on the design of the hinge mechanism or of the pull-release cable.

The side parts preferably have a plurality of segments and/or are manufactured from a flexible material in a tip region of the sliding board. The segments are arranged one behind another in the longitudinal direction and are separated from one another or are connected by a pliant material. The flexible material may be a rubber material. This permits adaptation of the folded-over side part to the bent-up portion in the tip region.

Advantageously, the side parts comprise, on an edge located at the bottom in the second position, gripping means for improving the grip during ascent on hard terrain. The outer edge, the inner edge or the two edges can be equipped here with said gripping means. The gripping means are, in particular, edges, elements or surfaces of a suitable material and with a suitable geometry or profiling. The gripping means can entirely or partially take on the function of a crampon or can make the use of a crampon unnecessary in a certain situation.

Advantageously, a basic body of the central part has side surfaces running obliquely relative to the upper side and lower side, and the basic bodies of the side parts have correspondingly obliquely running side surfaces which, in the first position, interact with the side surfaces of the central part in such a manner that they transmit vertical forces, acting on the lower side of the side parts, to the central part. As a result, in particular the connection between central part and side parts is also relieved of load.

A container which can be filled with snow is preferably attached to the sliding board in order to increase a dead weight of the piece of snow sports equipment for the descent. The smoothness of the snow sports equipment is improved as a result. The container can be delimited downwards by the upper side of the central part and upwards by a net. The net permits a lightweight design and simplifies the filling.

The container for filling with snow can in principle also be realized in conjunction with a piece of snow sports equipment without foldable side parts where it also combines the advantages of a lightweight sliding board for the ascent and a heavier sliding board for the descent.

Further advantageous embodiments and combinations of features of the invention emerge from the detailed description below and the entirety of the patent claims.

BRIEF DESCRIPTION OF THE DRAWINGS

In the drawings used for explaining the exemplary embodiment.

In principle, identical parts are provided with the same reference numbers in the figures.

WAYS OF IMPLEMENTING THE INVENTION

Figure 1:
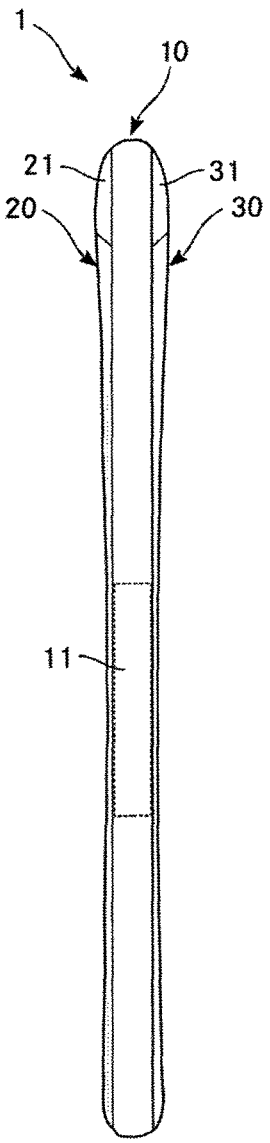
FIG. 1 shows a top view of an embodiment of the piece of snow sports equipment according to the invention.

FIG. 1 shows a top view of an embodiment of the piece of snow sports equipment according to the invention. The top view shows the descent position. The piece of snow sports equipment is a ski 1 which is suitable in particular for cross-country skiing. It comprises a central part 10 with a substantially uniform width over the entire length of the ski 1, and two tapered side parts 20, 30 which are arranged on the central part on both sides. The tapering of the side parts 20, 30 is such that a reduced ski width is produced in a central longitudinal portion of the ski 1, corresponding to a customary tapering of skis. The region 11 in which a binding is arranged on the central part 10 is located approximately in the region of minimum ski width. In the tip region, the side parts 20, 30 have portions 21, 31 which, as is described in more detail further below, are specially designed so that they can be matched to the curved shape of the tip of the ski 1 when the side parts 20, 30 are folded over.

Figure 2A:
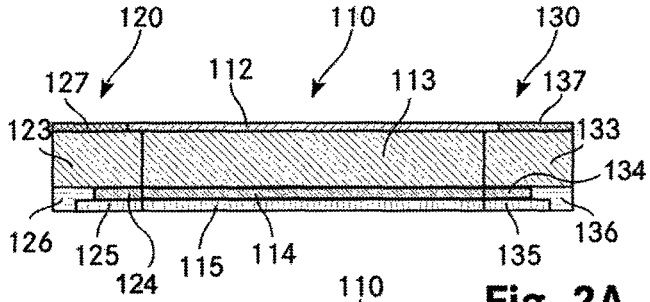
FIGS. 2A, B show schematic cross sections through the piece of snow sports equipment in the descent position and in the ascent position.
Figure 2B:
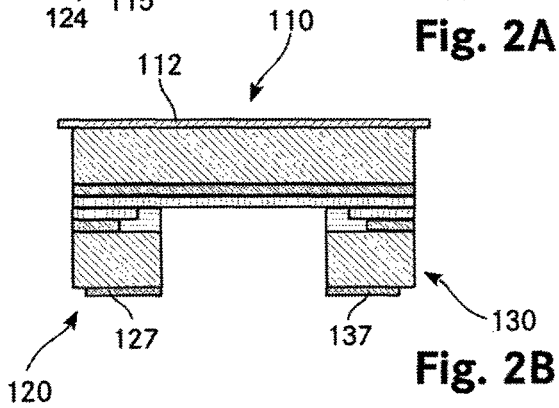

FIGS. 2A, 2B show schematic cross sections through the piece of snow sports equipment in the descent position and in the ascent position. In the descent position shown in FIG. 2A, the side parts 120, 130 are arranged at the sides of the central part 110, and are located below the central part 110 in the ascent position shown in FIG. 2B.

The central part 110 comprises a basic body 113 which can be designed in a manner known per se from ski manufacturing and comprises, for example, a rigid foam core which is enclosed along the main surfaces thereof by an upper flange and a lower flange (for example made of aluminum or glass-fiber-reinforced plastic). The basic body 113 is covered on the upper side by a cover sheet 112. A laminate layer 114 and a sliding coating 115 are arranged on the lower side of the basic body 113.

The layered construction of the side parts 120, 130 is substantially analogous in an inner region to the central part 110: instead of the cover sheet, a climbing skin 127, 137 is fixedly arranged on the upper side of the side parts 120, 130. Said climbing skin does not extend as far as the inner end surface, and therefore a recess is formed on the upper side. In the descent position shown in FIG. 2A, the cover sheet 112 of the central part 110 reaches beyond the side parts 120, 130, and the outermost cover-sheet portions protruding beyond the central part 110 are accommodated by the recesses of the side parts 120, 130.

A basic body 123, 133 which is constructed analogously to that of the central part is connected in turn below the climbing skin 127, 137 and the recesses. A laminate layer 124, 134 and a sliding coating 125, 135 subsequently follow in turn. The laminate layer 124, 134 and the sliding coating 125, 135 do not extend as far as the outer side surface of the side parts 120, 130; said side surface is instead formed in the region of said layers by a descent edge 126, 136. In the descent position, the side parts 120, 130 are fastened to the central part 110 in such a manner that the customary construction of a ski with a continuous sliding surface and lateral edges is produced.

In the ascent position shown in FIG. 2B, the two side parts 120, 130 are folded under the central part 110. The lowermost surface of the ski is therefore formed by the climbing skins 127, 137 on the side parts 120, 130. The cover sheet 112 protrudes slightly beyond the side surfaces of the central part 110. The height of the ski is increased, the width is reduced.

Figure 3A:
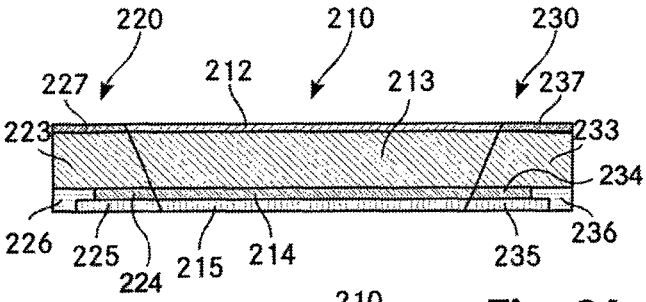
FIGS. 3A, B show schematic cross sections through a second embodiment of the piece of snow sports equipment in the descent position and in the ascent position.
Figure 3B:
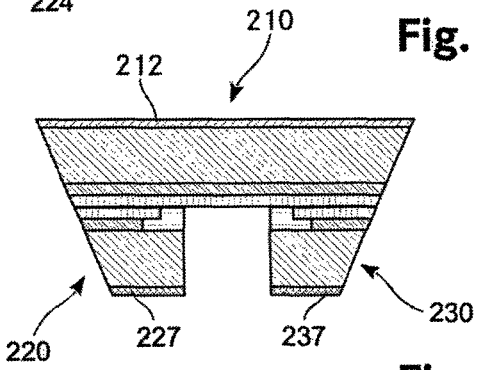

FIGS. 3A, 3B show schematic cross sections through a second embodiment of the piece of snow sports equipment in the descent position and in the ascent position. In the descent position shown in FIG. 3A, the side parts 220, 230 are arranged at the sides of the central part 210, and they are located below the central part 210 in the ascent position shown in FIG. 3B.

The central part 210 comprises a basic body 213 which can be designed in a manner known per se from ski manufacturing and comprises, for example, a rigid foam core which is enclosed along the main surfaces thereof by an upper flange and a lower flange (for example made from aluminum or glass-fiber-reinforced plastic). On the upper side, the basic body 213 is covered by a cover sheet 212. A laminate layer 214 and a sliding coating 215 are arranged on the lower side of the basic body 213.

The central part 210 has a trapezoidal cross section, wherein a width decreases from the top (i.e. starting from the cover sheet 212) downwards (towards the sliding surface 215). The side parts accordingly have an obliquely running inner end surface in such a manner that, in the descent position according to FIG. 3A, the cross sections complement one another to form the desired overall cross section of the ski.

The layered construction of the side parts 220, 230 is substantially analogous in an inner region to the central part 210: instead of the cover sheet, a climbing skin 227, 237 is arranged fixedly on the upper side of the side parts 220, 230. A basic body 223, 233 which is constructed analogously to that of the central part is connected in turn below the climbing skin 227, 237. A laminate layer 224, 234 and a sliding coating 225, 235 subsequently follow in turn. The laminate layer 224, 234 and the sliding coating 225, 235 do not extend as far as the outer side surface of the side parts 220, 230; said side surface is instead formed in the region of said layers by a descent edge 226, 236. In the descent position, the side parts 220, 230 are fastened to the central part 210 in such a manner that the customary construction of a ski with a continuous sliding surface and lateral edges is produced.

In the ascent position shown in FIG. 3B, the two side parts 220, 230 are folded under the central part 210. The lowermost surface of the ski is therefore formed by the climbing skins 227, 237 on the side parts 220, 230. The height of the ski is increased, the width is reduced, wherein the latter decreases starting from the top (the cover sheet 212 of the central part) downwards (towards the climbing skins 227, 237).

In a further embodiment (not illustrated), the central part has a trapezoidal cross section, the width of which increases from the top (i.e. starting from the cover sheet) downwards (towards the sliding surface). The side parts accordingly have an inner end surface which runs obliquely in a different direction in such a manner that, in the descent position the cross sections complement each other to form the desired overall cross section of the ski.

Figure 4:
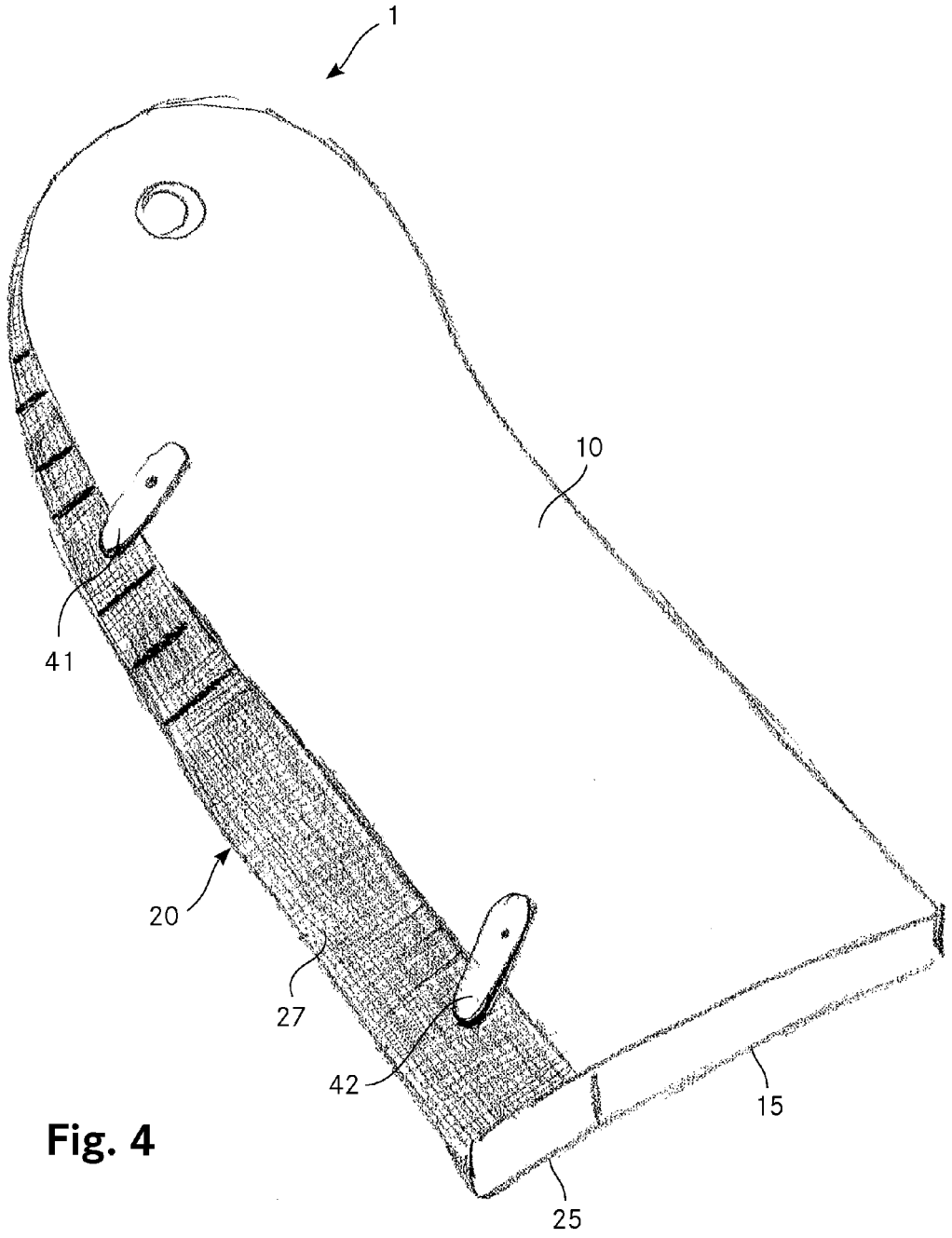
FIG. 4 shows an oblique view of the front part of the first embodiment in the descent position.

FIG. 4 is an oblique view of the front part of the first embodiment in the descent position. The side part of the ski 1 is raised and forms a continuous sliding surface 15, 25 and a continuous upper side with the central part 10, wherein the upper side of the side part 20 is formed by a climbing skin 27. Locking levers 41, 42 are arranged on the central part 10 so as to be pivotable about vertical axes and transmit forces transmitted from below to the side part 20 to the central part 10. Said locking levers therefore prevent the side part 20 from being pushed upwards beyond the position shown.

Figure 5:
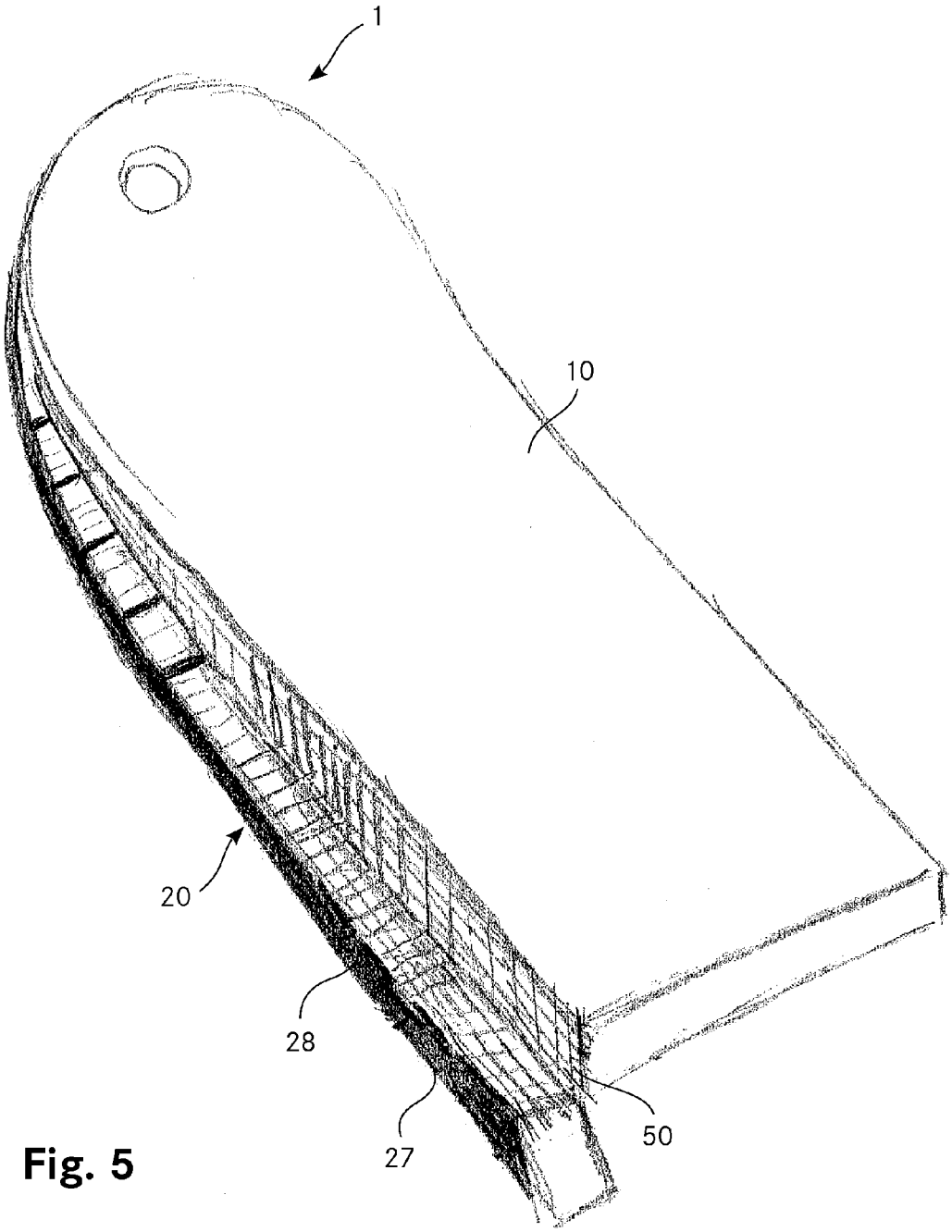
FIG. 5 shows an oblique view of the front part when a side part is folded over.

FIG. 5 is an oblique view of the front part when a side part is folded over. It therefore shows an intermediate position between the descent position and the ascent position. The side part 20 is arranged on the central part 10 of the ski 1 via a band 50. Said band 50 is composed, for example, of a fiber-reinforced elastomer and is firmly adhesively bonded by one of the main surfaces thereof to the outer side surface of the central part 10 and to the inner side surface of the side part 20. The other main surface of the band 50 is free. The climbing skin 27 and an ascent edge 28 can also be seen in FIG. 5.

Figure 6:
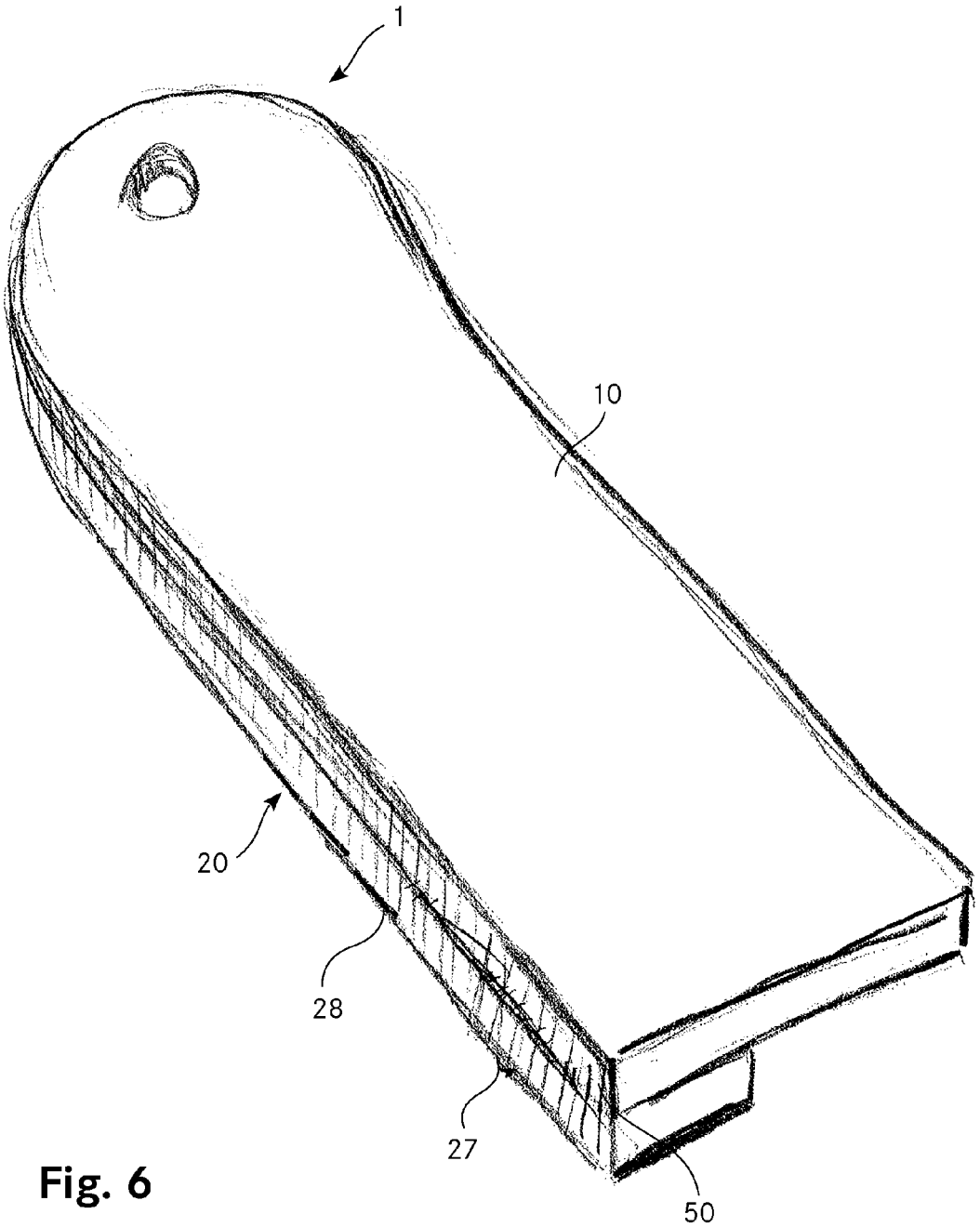
FIG. 6 shows an oblique view of the front part in the ascent position.

FIG. 6 is an oblique view of the front part in the ascent position. The side part 20 is therefore folded completely under the central part 10 of the ski 1. The climbing skin 27 now forms the lower side of the side part 20. The side surface of the ski 1 is formed by the band 50, the ascent edge forms the outer lower edge of the ski 1.

Figure 7:
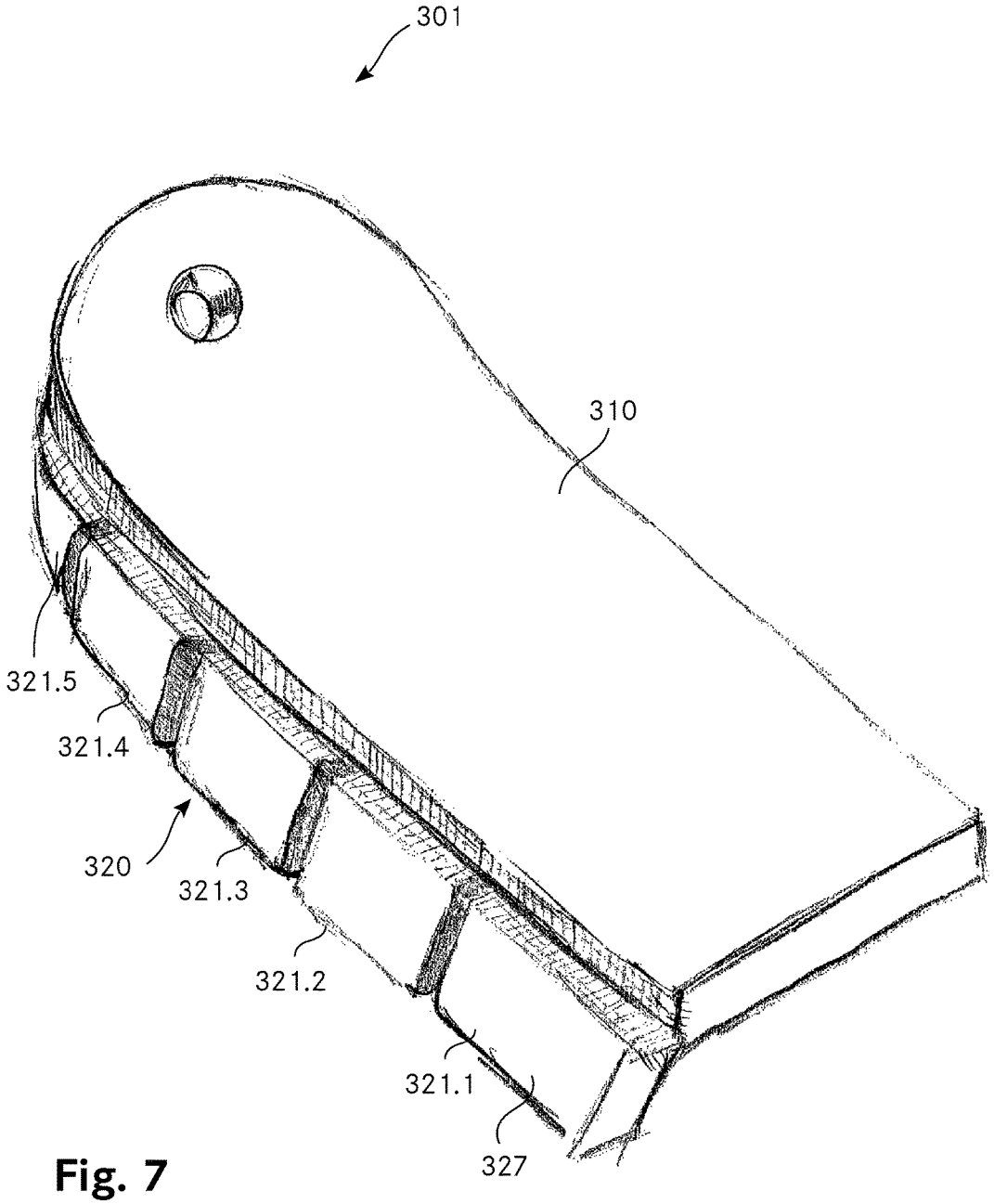
FIG. 7 shows an oblique view of a front part of a third embodiment with a segmented tip portion of the side part.

FIG. 7 is an oblique view of a front part of a third embodiment with a segmented tip portion of the side part. The side part 320 is in turn arranged at the side of the central part 310 of the ski 301. However, in the tip region, the side part 320 now comprises a plurality of segments 321.1, . . . , 321.5 which are attached laterally to the central part 310 in the customary manner, for example via a band, but are fastened to one another in the longitudinal direction merely via a flexible portion of material. This makes it possible for the segments 321.1 . . . 5 to fold over under the tip region of the ski 301 with a different angle of slope. A climbing skin 327 may be arranged in turn on the upper surface of the segments 321.1 . . . 5; this may not be necessary in the case of the frontmost segments 321.4, 321.5 because the latter generally do not come into engagement with the underlying surface.

Figure 8:
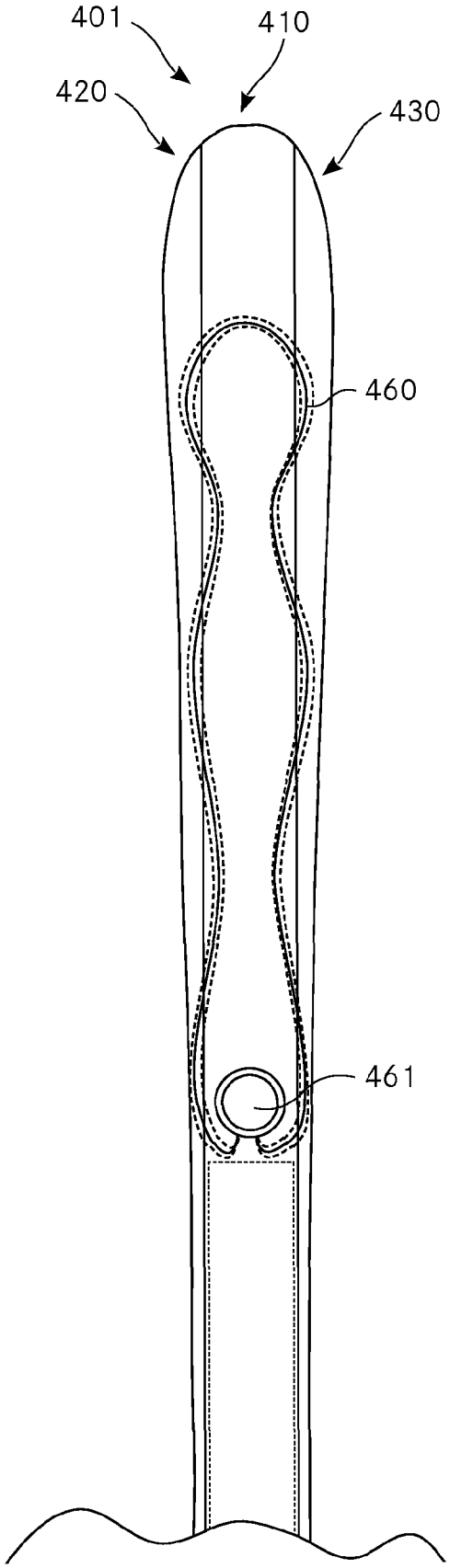
FIG. 8 shows a top view of a front part of a fourth embodiment.

FIG. 8 shows a top view of a front part of a fourth embodiment. In this embodiment, the side parts 420, 430 are connected to the central part 410 via a pull-release cable 460. For this purpose, the central part 41 and the side parts 420, 430 comprise channels which run in the interior parallel to the main surface of the ski and in which the pull-release cable 460 is accommodated. The channels run in an alternating manner in the central part 410 and one of the side parts 420, 430, wherein, in a frontmost portion of the course, the pull-release cable 460 runs from the left side (as seen from the top), starting from the side part 420 through the central part 410 to the right side, into the side part 430. At the rear end of the course, the cable of the pull-release cable is first of all guided from the side parts 420, 430 into the central part 410 and into a tensioning device 461 there, with which, by rotation of a button of the tensioning device 461, the cable can be tensioned and, by pressing the button, the cable can be relaxed. Tensioning devices 461 of this type are known per se and are commercially available, namely from Boa Technology Inc., Denver (Colo.), USA.

The channels in the side parts 420, 430 and in the central part 410 are shaped in such a manner that a maximum angle of curvature does not fall below a certain value and that the cable of the pull-release cable 460 therefore does not have to perform any abrupt changes in direction resulting in a large amount of resistance. The mouths of the channels in the side parts 420, 430 and in the central part 410 are coordinated with each other such that, when the cable is tensioned, the side parts 420, 430 are suitably arranged on the central part 410 both in the longitudinal direction and in the vertical direction. In the transverse direction, the side parts 420, 430 bear fixedly against the central part 410 such that functionally, in the descent position, a standard sliding board is formed.

A similar pull-release cable (not illustrated here) runs in the rear part of the ski 401.

By pressing of the buttons of the tensioning devices, the cables of the pull-release cables are released, and the side parts 420, 430 can fold downwards under the central part 410. They can be connected there to each other, as mentioned above, by hook-like connecting elements running parallel to the main surfaces of the central part 410. Subsequently, the cables are tensioned again in order to ensure a fixed seat. The ascent position is therefore reached.

In order to pass again from the ascent position into the descent position, first of all the cable is released, followed by the connecting elements. By tensioning the cables, the side parts 420, 430 are raised again and pass into the arrangement thereof for the descent position.

Figure 9:
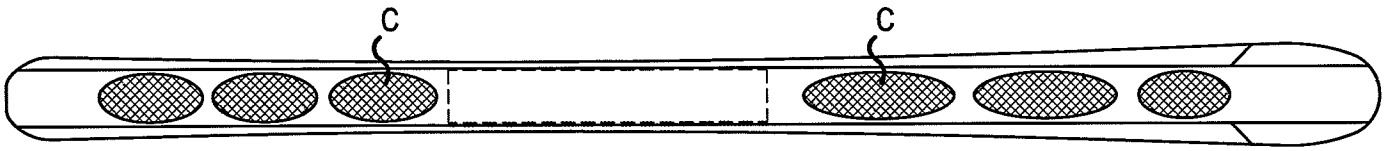
FIG. 9 is a top view of an additional embodiment of the invention.
Figure 10:
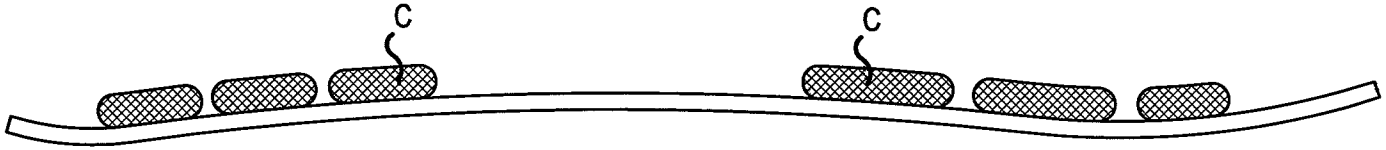
FIG. 10 is a side view of the embodiment of FIG. 9.

FIGS. 9 and 10 illustrate an additional feature of the invention. FIG. 9 is a top view of a piece of snow sports equipment according to the invention including one or more containers C which can be filled with snow in order to increase a dead weight of the equipment for the descent. FIG. 10 is a side view thereof. As previously noted, the container has a lower part on the upper side of the sliding board and there is a upper limit defined by a net.

The invention is not restricted to the exemplary embodiments illustrated. Structural details can be realized in some other way, or elements of different exemplary embodiments can be combined with one another. The invention is not restricted to skis, but can also be used, for example, in the case of what are referred to as splitboards.

The sketched internal construction of the ski should be understood merely as an example; in principle, the invention can be realized with most currently known structures.

In summary, it should be emphasized that the invention provides a piece of snow sports equipment which exhibits improved properties both on the descent and for the ascent.

The invention claimed is:

1. A piece of snow sports equipment, comprising a sliding board with a substantially planar central part which extends in a longitudinal direction, and two substantially planar side parts which are fastened to the central part on both sides, wherein a) the central part has a sliding coating on a lower side, b) the side parts are foldable over from a first position, in which a first main surface of the side parts is substantially co-planar with the lower side of the central part, to a second position, in which the side parts are folded under the central part such that the first main surfaces of the side parts are supported on the lower side of the central part, and wherein c) second main surfaces of the side parts, which second main surfaces are opposite the first main surfaces, have a climbing skin.

2. The piece of snow sports equipment of claim 1, wherein the side parts have a descent edge on an edge located on the outside in the first position and a sliding coating on the first main surface.

3. The piece of snow sports equipment of claim 1, wherein the central part has a main portion with a substantially constant width along the longitudinal direction, and in that the side parts have a tapering in a portion, the longitudinal extent of which corresponds to that of the main portion of the central part.

4. The piece of snow sports equipment of claim 1, wherein the climbing skin is attached fixedly on the second main surface.

5. The piece of snow sports equipment of claim 1, wherein a hinge mechanism is arranged between the central part and each of the side parts, wherein the hinge mechanism comprises a band which is fastened on a side surface of the central part and on a side surface of the side part.

6. The piece of snow sports equipment of claim 5, wherein the at least one pull-release cable comprises a cable which is guided through through-openings in the central part and in at least one of the side parts, and a tensioning and locking mechanism for tensioning and locking the cable when the at least one side part is in the first or second position.

7. The piece of snow sports equipment of claim 6, wherein the through-openings are arranged in the central part and in the at least one side part in such a manner that, in the first position of the at least one side part, the cable runs entirely within the central part and at least one side part in a contact region of the central part and of the at least one side part.

8. The piece of snow sports equipment of claim 1, wherein the central part and the side parts are connected to each other by at least one pull-release cable.

9. The piece of snow sports equipment of claim 1, comprising means for locking the side parts in the second position, wherein the means for locking comprise elements for the mutual fastening of the side parts to one another.

10. The piece of snow sports equipment of claim 1, comprising locking elements arranged on an upper side of the central part for supporting the side parts in the first position.

11. The piece of snow sports equipment of claim 1, wherein the central part has a cover sheet on an upper side, wherein the cover sheet protrudes laterally beyond the central part in order to support the side parts in the first position.

12. The piece of snow sports equipment of claim 1, wherein the side parts have a plurality of segments and comprise a flexible material in a tip region of the sliding board.

13. The piece of snow sports equipment of claim 1, wherein the side parts comprise, on an edge located at the bottom thereof in the second position, gripping means for improving the grip during ascent on hard terrain.

14. The piece of snow sports equipment of claim 1, wherein the central part has side surfaces running obliquely relative to the upper surface and lower surface thereof, and the side parts have correspondingly obliquely running side surfaces which, in the first position, interact with the side surfaces of the central part in such a manner that they transmit vertical forces, acting on the lower side of the side parts, to the central part.

15. The piece of snow sports equipment of claim 1, comprising a container which can be filled with snow being attached on said piece of snow sports equipment in order to increase a dead weight of the piece of snow sports equipment for the descent.

* * * * *